US008516621B2

(12) United States Patent
Woolery

(10) Patent No.: US 8,516,621 B2
(45) Date of Patent: Aug. 27, 2013

(54) MAGNETIC WORK CLOTHES

(75) Inventor: Andre A. Woolery, Menlo Park, CA (US)

(73) Assignee: AAW Products, Inc., Menlo Park, CA (US)

( * ) Notice: Subject to any disclaimer, the term of this patent is extended or adjusted under 35 U.S.C. 154(b) by 731 days.

(21) Appl. No.: 12/287,297

(22) Filed: Oct. 7, 2008

(65) Prior Publication Data

US 2009/0094801 A1 Apr. 16, 2009

Related U.S. Application Data

(60) Provisional application No. 60/998,839, filed on Oct. 11, 2007, provisional application No. 61/003,751, filed on Nov. 19, 2007, provisional application No. 61/004,440, filed on Nov. 26, 2007.

(51) Int. Cl.
*A41F 19/00* (2006.01)

(52) U.S. Cl.
USPC ..... 2/310; 2/300; 2/326

(58) Field of Classification Search
USPC ..... 2/44, 45, 229, 230, 300, 305, 309, 2/310, 311, 327, 328–335, 340, 312, 317, 2/318, 326; 224/665
See application file for complete search history.

(56) References Cited

U.S. PATENT DOCUMENTS

| | | | | |
|---|---|---|---|---|
| 178,611 | A * | 6/1876 | Dye | 607/149 |
| 625,423 | A * | 5/1899 | Scriven | 2/401 |
| D59,955 | S | 12/1921 | Farnham | D20/25 |
| 1,724,069 | A | 8/1929 | Butera | |
| 2,456,445 | A | 12/1948 | Rees et al. | |
| 2,597,601 | A | 5/1952 | Sherman | |
| 3,161,932 | A * | 12/1964 | Russell | 24/303 |
| 3,180,641 | A | 4/1965 | Shane | |
| 3,220,018 | A * | 11/1965 | Johnson | 2/310 |
| 3,256,529 | A * | 6/1966 | Panepinto | 2/301 |
| 3,886,508 | A | 5/1975 | Lavrard | 335/285 |
| 3,933,286 | A | 1/1976 | Karkas | |
| D238,821 | S | 2/1976 | Romani | D11/44 |
| 3,943,912 | A | 3/1976 | Nakayama | 128/1.3 |
| 3,997,092 | A | 12/1976 | Pogwizd | 224/5 A |
| 4,068,784 | A | 1/1978 | Angell | |
| 4,069,954 | A | 1/1978 | Rauch | 224/5 C |
| 4,103,779 | A | 8/1978 | Wagner | 211/65 |
| 4,182,470 | A | 1/1980 | Atkinson | |
| 4,432,477 | A | 2/1984 | Haidt et al. | |

(Continued)

FOREIGN PATENT DOCUMENTS

FR 2747274 A1 10/1997

OTHER PUBLICATIONS http://www.artmakers.com/magneto.
http://www.buildingonline.com/news.

(Continued)

*Primary Examiner* — Khoa Huynh
*Assistant Examiner* — Brieanna Fuller
(74) *Attorney, Agent, or Firm* — Haverstock & Owens LLP

(57) ABSTRACT

Magnetic work clothes for holding work items comprise a body having a surface and one or more magnets coupled to the surface for holding work items. The one or more magnets providing a magnetic force for attracting magnetically attractable objects and securing them to the surface such that they are readily available for use. The body comprising a pair of suspenders, a vest, an apron or any other suitable clothing item.

7 Claims, 3 Drawing Sheets

(56) References Cited

U.S. PATENT DOCUMENTS

| | | | | | |
|---|---|---|---|---|---|
| 4,480,596 | A | * | 11/1984 | Shumiyashu | 600/15 |
| 4,544,067 | A | | 10/1985 | Miller | |
| 4,587,956 | A | | 5/1986 | Griffin et al. | 128/1.3 |
| 4,826,059 | A | | 5/1989 | Bosch et al. | 224/183 |
| 4,917,644 | A | * | 4/1990 | Sunshine | 446/26 |
| 5,025,966 | A | | 6/1991 | Potter | |
| 5,199,621 | A | | 4/1993 | McLennan | 224/253 |
| 5,213,240 | A | | 5/1993 | Dietz et al. | |
| 5,333,767 | A | | 8/1994 | Anderson | 224/183 |
| 5,341,975 | A | | 8/1994 | Marinescu | |
| 5,385,281 | A | | 1/1995 | Byrd | 224/148 |
| 5,388,740 | A | | 2/1995 | Garland | |
| 5,484,057 | A | | 1/1996 | Tzu-Ching | |
| 5,593,073 | A | | 1/1997 | Finnegan | 224/183 |
| 5,623,735 | A | * | 4/1997 | Perry | 2/327 |
| 5,632,426 | A | | 5/1997 | Beletsky et al. | |
| 5,642,847 | A | * | 7/1997 | DeMeo et al. | 224/623 |
| 5,707,333 | A | * | 1/1998 | Bakst | 600/9 |
| 5,758,807 | A | | 6/1998 | Wright | 224/183 |
| 5,782,743 | A | * | 7/1998 | Russell | 600/9 |
| 5,820,000 | A | | 10/1998 | Timberlake et al. | |
| 5,894,971 | A | | 4/1999 | Huang | 224/218 |
| 5,950,239 | A | * | 9/1999 | Lopez | 2/115 |
| 5,984,046 | A | | 11/1999 | Urso, Jr. | |
| 5,989,101 | A | * | 11/1999 | Jenn-Shyang et al. | 450/57 |
| 6,006,365 | A | * | 12/1999 | Strandberg | 2/329 |
| 6,006,906 | A | | 12/1999 | Winnard | |
| 6,049,914 | A | | 4/2000 | Heilman | 2/247 |
| 6,093,143 | A | * | 7/2000 | Nagler | 600/15 |
| 6,125,475 | A | * | 10/2000 | Taylor | 2/333 |
| 6,267,277 | B1 | | 7/2001 | Taylor | 224/183 |
| 6,325,577 | B1 | | 12/2001 | Anderson | |
| 6,330,961 | B1 | | 12/2001 | Borja | 224/222 |
| 6,332,862 | B1 | * | 12/2001 | Zandman | 600/15 |
| 6,336,555 | B1 | | 1/2002 | Breeden | 206/371 |
| 6,401,253 | B2 | | 6/2002 | Brunson | |
| 6,405,381 | B1 | | 6/2002 | Bowman, Jr. | 2/170 |
| 6,406,418 | B1 | * | 6/2002 | Getek | 600/15 |
| 6,457,252 | B1 | | 10/2002 | Kershner | |
| 6,481,017 | B2 | | 11/2002 | Mullis | 2/69 |
| 6,530,508 | B1 | | 3/2003 | Devine | 224/183 |
| 6,561,402 | B2 | | 5/2003 | Holland et al. | |
| 6,571,997 | B2 | | 6/2003 | Dedrick | 224/183 |
| 6,587,022 | B1 | | 7/2003 | Devine | 335/285 |
| 6,610,023 | B2 | * | 8/2003 | Steponovich | 602/26 |
| 6,643,845 | B2 | | 11/2003 | O'Dea et al. | |
| 6,658,756 | B1 | | 12/2003 | Sanchez, Jr. | |
| 6,675,965 | B2 | | 1/2004 | Holland et al. | 206/338 |
| 6,719,178 | B1 | * | 4/2004 | Taylor | 224/148.7 |
| 6,779,199 | B1 | | 8/2004 | O'Dea et al. | 2/161.6 |
| 6,836,899 | B1 | * | 1/2005 | Glasmire | 2/52 |
| 6,925,656 | B2 | * | 8/2005 | Henderson | 2/310 |
| 7,000,732 | B1 | | 2/2006 | Briggs Jr. | 182/129 |
| 7,048,162 | B2 | | 5/2006 | Frye et al. | 224/222 |
| 7,076,885 | B2 | | 7/2006 | Potter | |
| 7,146,651 | B1 | * | 12/2006 | Lapin | 2/338 |
| 7,373,696 | B2 | * | 5/2008 | Schoening et al. | 24/66.1 |
| 7,490,724 | B2 | | 2/2009 | Week et al. | |
| D611,678 | S | * | 3/2010 | Bailey | D2/624 |
| 2001/0054630 | A1 | * | 12/2001 | Crabill | 224/153 |
| 2002/0104151 | A1 | * | 8/2002 | Rauscher | 2/338 |
| 2002/0113105 | A1 | * | 8/2002 | Jarman | 224/260 |
| 2002/0175100 | A1 | | 11/2002 | Holland et al. | |
| 2003/0052143 | A1 | | 3/2003 | Devine | 224/183 |
| 2003/0197042 | A1 | | 10/2003 | Warren | |
| 2003/0230606 | A1 | | 12/2003 | Devinie | 224/183 |
| 2004/0173484 | A1 | | 9/2004 | Bates et al. | |
| 2004/0178236 | A1 | * | 9/2004 | Kakouras | 224/150 |
| 2005/0040194 | A1 | | 2/2005 | Frye et al. | 224/219 |
| 2005/0082323 | A1 | | 4/2005 | O'Hair | 224/219 |
| 2005/0263550 | A1 | | 12/2005 | Williams | 224/221 |
| 2006/0011679 | A1 | | 1/2006 | Santiago | 224/222 |
| 2006/0016841 | A1 | | 1/2006 | Shurm | 224/222 |
| 2006/0027613 | A1 | * | 2/2006 | Chang | 224/183 |
| 2006/0032876 | A1 | | 2/2006 | Goffinet | |
| 2006/0102678 | A1 | | 5/2006 | Bommarito | |
| 2006/0261113 | A1 | | 11/2006 | Godshaw et al. | |
| 2006/0272076 | A1 | * | 12/2006 | Schroeder | 2/336 |
| 2007/0006367 | A1 | | 1/2007 | Newman et al. | |
| 2007/0199426 | A1 | * | 8/2007 | Tafolla | 84/327 |
| 2008/0185414 | A1 | | 8/2008 | Conlon | |
| 2009/0127146 | A1 | | 5/2009 | Krebs et al. | |
| 2009/0289090 | A1 | * | 11/2009 | Fullerton et al. | 224/183 |
| 2010/0193557 | A1 | * | 8/2010 | Clinton et al. | 224/576 |
| 2011/0083254 | A1 | * | 4/2011 | Trutna et al. | 2/326 |

OTHER PUBLICATIONS http://www.smarthome.com/89091.
http://www.diynetwork.com/diy.

* cited by examiner

MAGNETIC WORK CLOTHES

RELATED APPLICATIONS

The Patent Application claims priority under 35 U.S.C. section 119(e) to the co-pending U.S. Provisional Patent Application Ser. No. 60/998,839, filed Oct. 11, 2007, and entitled "MAGNETIC TOOL HOLDERS," to the co-pending U.S. Provisional Patent Application Ser. No. 61/003,751, filed Nov. 19, 2007, and entitled "MAGNETIC TOOL HOLDERS" and to the co-pending U.S. Provisional Patent Application Ser. No. 61/004,440, filed Nov. 26, 2007, and entitled "MAGNETIC TOOL HOLDERS," all of which are hereby incorporated by reference.

FIELD OF THE INVENTION

The present invention generally relates to magnetic work clothes. More particularly the present invention relates to a magnetic apron, magnetic vest and magnetic suspenders.

BACKGROUND OF THE INVENTION

Professional users of small hand tools such as carpenters, seamstresses, auto mechanics, electricians, plumbers, construction workers, as well as non-professional do-it-yourselfers are often frustrated whenever they misplace, drop or fumble tools or supplies while doing their jobs. Workers often times wear aprons or similar devices to hold these supplies to keep them close at hand and also to be able to move more freely. However, wearing an apron or similar device has certain limitations. For instance, repetitive reaching in pockets for supplies is tedious. Moreover, wearing an apron or similar device does not help the task of reaching for supplies while holding a perfectly aligned work piece or holding a heavy work piece with one hand and some other tool with the other. Additionally, aprons and similar devices are prone to accidentally spill the tools and work items that are held within the pockets of the apron or similar device. Often this spillage is caused because the worker accidentally knocked the tools or work items over with their hand, or because of how the worker is positioned while doing their job. Other times the contents will spill whenever the worker removes the pouch from his waist and puts it down.

SUMMARY OF THE INVENTION

Magnetic clothing items for holding work items comprise a body having a surface and one or more magnets wherein the one or more magnets are coupled to the surface for holding the work items to the surface of the body.

One aspect of the application is directed to a clothing item. The clothing item comprises a body having a surface and one or more magnets coupled to the surface for holding work items. In some embodiments, the body comprises a pair of suspenders. In other embodiments, the body comprises an apron. In yet other embodiments, the body comprises a vest. In some embodiments, the one or more magnets are removably attachable to the surface of the body. In other embodiments, the one or more magnets are completely enclosed within the surface. In yet other embodiments, the one or more magnets are accessible from within the surface. Typically, at least some portion of the one or more magnets is exposed. The shape of the one or more magnets is selected from a set comprising a strip, a ball bearing, and a disc. Also, the magnets are positioned to avoid mutual magnetic attraction between each other. In some embodiments, at least one of the one or more magnets comprise a neodymium magnet. In some embodiments, at least one of the one or more magnets comprise a ceramic magnet. The surface comprises any combination of leather, cotton, cotton/polyester blends, plastic, nylon, vinyl, neoprene, synthetic leather, rubber or other material. The surface further comprises a plurality of layers for housing the one or more magnets. In some embodiments of the present application, magnets are distributed across the surface so as to allow metallic items to be secured to substantially all points of the surface.

Another aspect of the present application is directed to a clothing item. The clothing item comprises a body having a surface comprising a plurality of layers and one or more magnets coupled to the surface for holding work items, wherein the one or more magnets are housed by and accessible from the plurality of layers, and further wherein the one or more magnets are completely enclosed within the plurality of layers. In some embodiments, the body comprises a pair of suspenders. In other embodiments, the body comprises an apron. In yet other embodiments, the body comprises a vest.

Yet another aspect of the present application is directed to a clothing item. The clothing item comprises a body having a surface comprising a plurality of layers and one or more magnets coupled to the surface for holding work items, wherein the one or more magnets are housed by and accessible from the plurality of layers, and further wherein the one or more magnets are completely enclosed within the plurality of layers, wherein the one or more magnets are distributed across the surface so as to allow metallic items to be secured to substantially all points of the surface. In some embodiments, the body comprises a pair of suspenders. In other embodiments, the body comprises an apron. In yet other embodiments, the body comprises a vest.

Another aspect of the present application is directed to a method of manufacturing a clothing item. The method comprises constructing a clothing body having a surface comprising a plurality of layers and coupling one or more magnets to the surface in a housing area formed by the plurality of layers. In some embodiments, the body comprises a pair of suspenders. In other embodiments, the body comprises an apron. In yet other embodiments, the body comprises a vest. Further, in some embodiments, the one or more magnets are removably attached to the surface. In some embodiments, the method further comprises completely enclosing the one or more magnets within the plurality of layers, wherein the one or more magnets are accessible from within the plurality of layers. Alternatively, at least some portion of the one or more magnets is exposed. The shape of the one or more magnets is selected from a set comprising a strip, a ball bearing, and a disc. In some embodiments, the method further comprises positioning the one or more magnets to avoid mutual magnetic attraction between each other. In some embodiments, at least one of the one or more magnets comprise a ceramic magnet and or a neodymium magnet. The surface comprises any combination of leather, cotton, cotton/polyester blends, plastic, nylon, vinyl, neoprene, synthetic leather, rubber or other material. In some embodiments, the method further comprises distributing the one or more magnets across the surface so as to allow metallic items to be secured to substantially all points of the surface.

DETAILED DESCRIPTION OF THE INVENTION

In the following description, numerous details are set forth for purpose of explanation. However, one of ordinary skill in the art will realize that the invention may be practiced without the use of these specific details.

Figure 1:
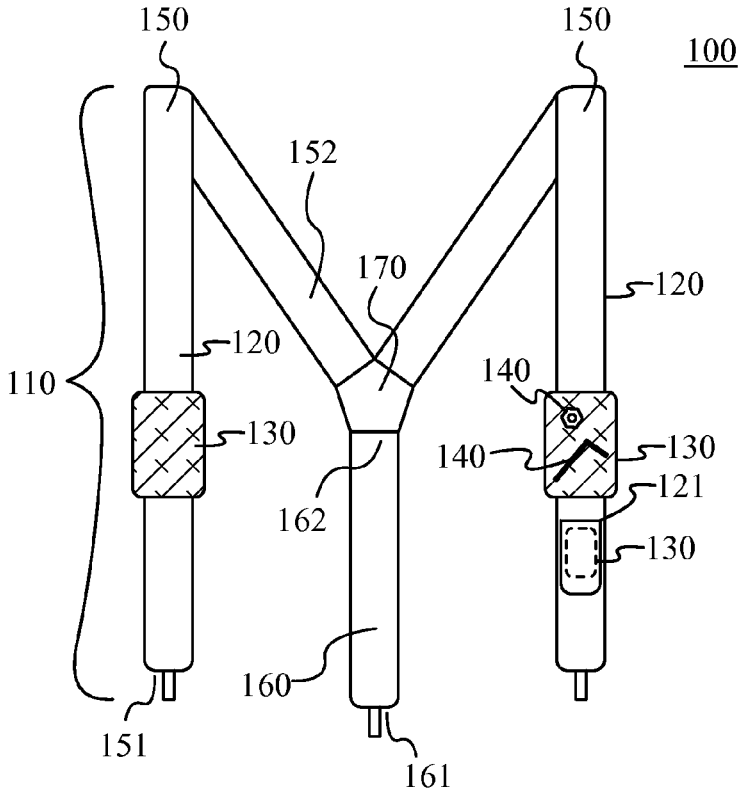
FIG. 1 illustrates a front view of one embodiment of the present application comprising a suspenders body.
Figure 2:
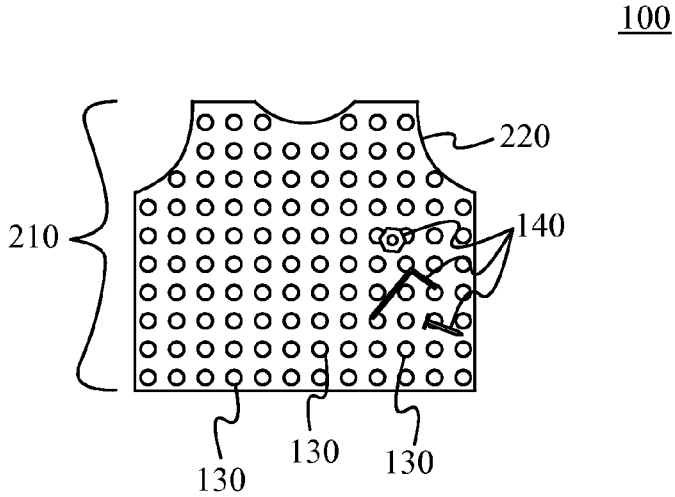
FIG. 2 illustrates a front view of another embodiment of the present application comprising a vest body.
Figure 3:
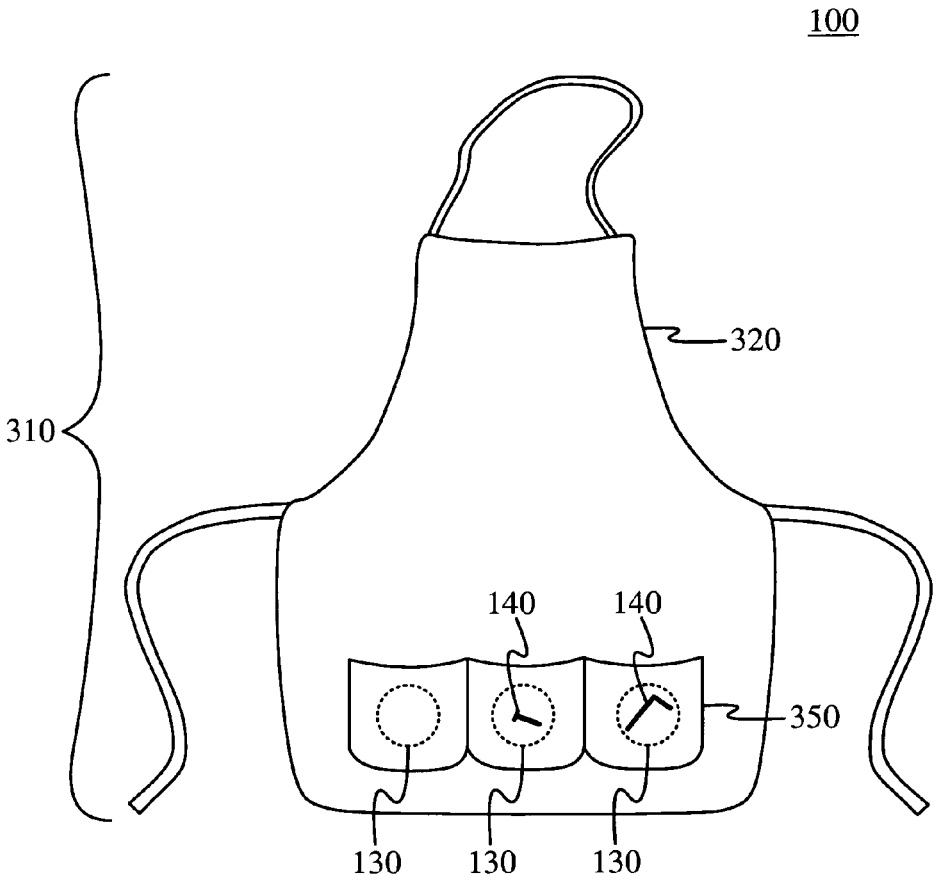
FIG. 3 illustrates a front view of yet another embodiment of the present application comprising an apron body.

Referring to FIG. 1, a first embodiment of the magnetic clothing item 100 is depicted therein. Specifically, the clothing item 100 shown comprises a suspenders body 110 having a surface 120, one or more magnets 130 coupled to the surface 120 and tools and items 140 magnetically secured to the surface 120 by the magnets 130. The suspenders body 110 further includes a pair of front straps 150 and a back strap 160 which are directly connected to a node 170. The front straps 150 and the back strap 160 each have an elongated length with a constant width that extends the entire elongated length. The front straps 150 have a proximal terminal end 151 and a distal terminal end 152 wherein the elongated length extends between the proximal terminal end 151 and the distal terminal end 152. Additionally, the back strap 160 has a proximal front end 161 and a distal back end 162 wherein the elongated length extends between the proximal front end 161 and the distal back end 162. The distal terminal ends 152 of the front straps 150 and the distal back end 162 of the back strap 160 are coupled directly to the node 170. It is noted that one or magnets 130 can be coupled directly to the surface 120 of each of the front straps 150 above the proximal terminal end 151 and that one or more magnets 130 have a magnetic face having a width that is wider than a constant width of the surface 120 of the front straps 150. Alternatively, the body of the clothing item 100 comprises a vest 210 as shown in FIG. 2, an apron 310 as shown in FIG. 3, or any other appropriate body. It is noted that the precise structure of the suspenders body 110 can take many forms which are each compatible with the present device and well known in the art.

The surface 120 is constructed from a flexible fabric such as woven cloth. Various other types and combinations of materials could alternatively be used including, but not limited to leather, cotton, cotton/polyester blends, plastic, nylon, vinyl, neoprene, synthetic leather, knit or rubber. In some embodiments, the surface further comprises a plurality of layers 121.

The magnets 130 are neodymium magnets, however in some embodiments, the magnets 130 are ceramic or any other type or combination of magnets. Neodymium has been chosen because it is one of the strongest permanent magnets made and does not lose its strength over time. Typically, a portion of the magnets 130 is exposed outside of the surface 120. Alternatively, layers of the surface 121 completely enclose and house the magnets 130. In some embodiments, the magnets 130 are accessible from the surface 120. Where the magnets 130 are accessible from the surface 120, various means are utilized to selectively seal them into the surface 120 to prevent them from falling out of place. These means include, but are not limited to buttons, buckles, snaps, hooks, threads or zippers. Alternatively, the one or more magnets 130 are inaccessible from the surface 120. In some embodiments, the magnets 130 are completely stitched into the surface 120. Additionally, the magnets 130 are strips. Alternatively, as shown in the embodiments of FIGS. 2 and 3, the magnets are either small balls or discs, respectively. In some embodiments, the shape of the magnets 130 comprises any combination of strips, discs or small balls.

As further shown in FIG. 1, the magnets 130 are substantially permanently coupled onto the surface 120. Alternatively, the magnets 130 are removably attached to the surface 120. Where the magnets 130 are removably attached to the surface 120, various means can be utilized to removably attach them to the surface 120. These means include, but are not limited to buttons, buckles, snaps, hooks, threads or zippers. In some embodiments, the magnets 130 are positioned along the surface 120 such that mutual magnetic attraction between each other is avoided. In some embodiments, the magnets 130 are sufficiently numerous and distributed across the surface so as to allow metallic tools and items 140 to be secured to substantially all points of the surface 120.

This design of the clothing item 100 allows a worker wearing the clothing item 100 to securely hold metallic tools and other items 140 in readily accessible locations along the body 110 via the magnetic attraction of the magnets 130 and thereby increase work production.

FIG. 2 shows another embodiment of the present device that is substantially the same as the embodiment shown in FIG. 1 except for the differences described herein. In FIG. 2, the clothing item 100 shown comprises a vest body 210 having a surface 220, one or more magnets 130 coupled to the surface 220 and tools and items 140 magnetically secured to the surface 220 by the magnets 130. It is noted that the precise structure of the vest body 210 can take many forms which are each compatible with the present application and well known in the art. As shown in this embodiment, the magnets 130 are ball bearings, however they may be strips, discs or any other appropriate shape. As further shown, the magnets 130 are sufficiently numerous and distributed across the surface 220 such that metallic tools and items 140 can be secured to substantially all points of the surface 220. Alternatively, the magnets 130 are positioned in specified areas along the surface 220 such that the tools and items 140 are only secured to those areas.

Yet another embodiment is shown in FIG. 3 which is substantially the same as the embodiment shown in FIG. 1 except for the differences described herein. In FIG. 3, the clothing item 100 shown comprises an apron body 310 having a surface 320, one or more magnets 130 coupled to the surface 320 and tools and items 140 magnetically secured to the surface 320 by the magnets 130. It is noted that the precise structure of the apron body 310 can take many forms which are each compatible with the present device and well known in the art. As shown in this embodiment, the magnets 130 are discs, however they may be strips, ball bearings or any other appropriate shape. As further shown, the surface 320 comprises layers 350, wherein the magnets 130 are completely enclosed and housed within the layers 350. Alternatively, a portion of the magnets 130 may be exposed from the layers to the outside. In some embodiments, the magnets 130 are accessible from the layers 350 wherein various means can be utilized to selectively fully enclose them within the surface 320 to prevent them from falling out of place. These means include, but are not limited to buttons, buckles, snaps, hooks, threads or zippers. Alternatively, the one or more magnets 130 are inaccessible from within the plurality of layers 350.

Figure 4:
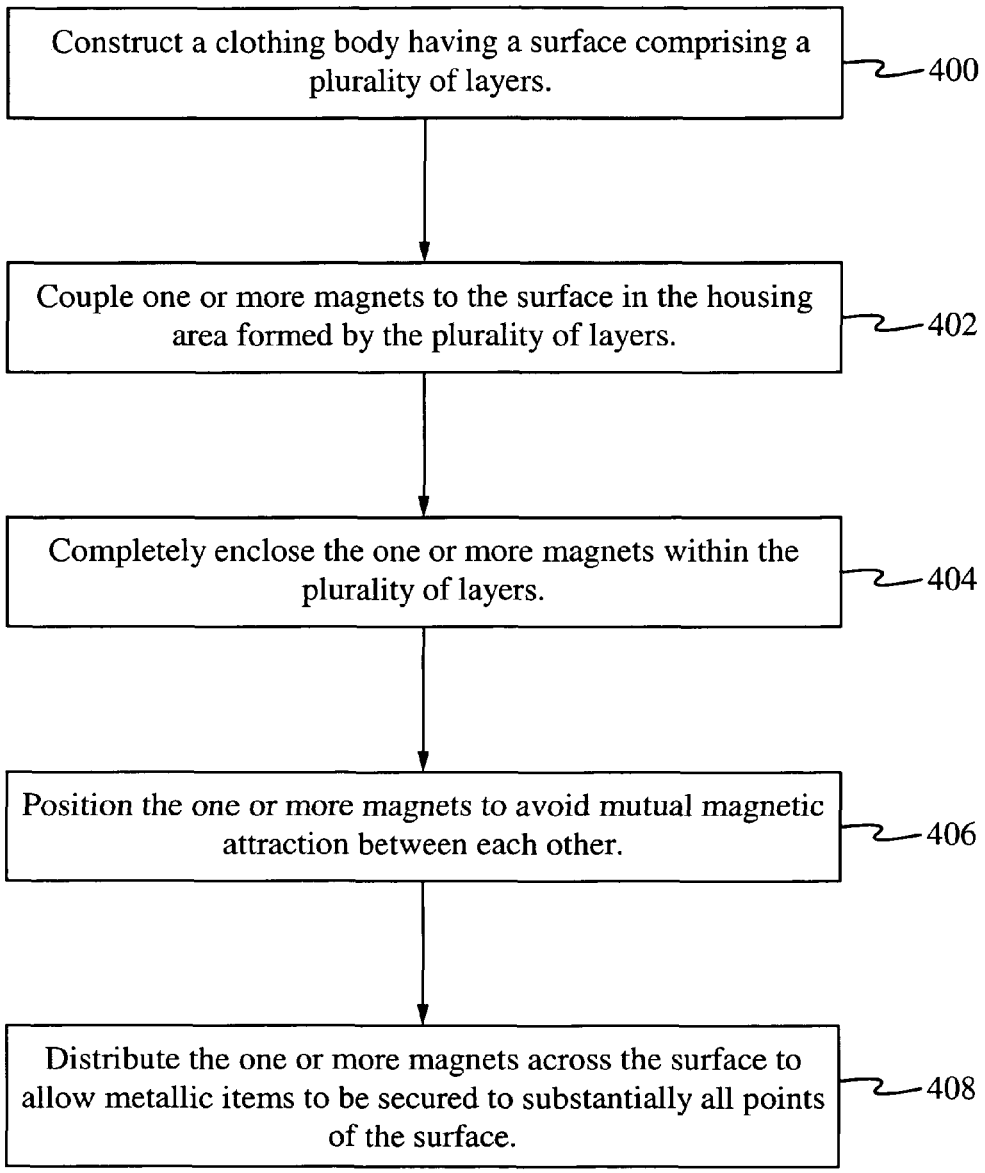
FIG. 4 illustrates a flow chart of one embodiment of a method of the present application.

One embodiment of the method of manufacture of the clothing item will now be discussed in conjunction with the flow chart illustrated in FIG. 4. In particular, a clothing body having a surface comprising a plurality of layers is constructed at the step 400. Then, one or more magnets are then coupled to the surface in a housing area formed by the plurality of layers at the step 402. In some embodiments, the body comprises a vest. In other embodiments, the body comprises an apron. In yet other embodiments, the body comprises a pair of suspenders. Further, in some embodiments, the one or more magnets are removably attached to the surface.

In some embodiments, the one or more magnets are completely enclosed within the plurality of layers at the step 404, wherein the one or more magnets are accessible from within the plurality of layers. Alternatively, the one or more magnets are inaccessible from within the plurality of layers. In some embodiments, at least some portion of the one or more magnets is exposed. The shape of the one or more magnets is selected from a set comprising a strip, a ball bearing, and a disc. In some embodiments, the one or more magnets are positioned to avoid mutual magnetic attraction between each other at the step 406. In some embodiments, at least one of the one or more magnets comprise a ceramic magnet and or a neodymium magnet. The surface comprises any combination of leather, cotton, cotton/polyester blends, plastic, nylon, vinyl, neoprene, synthetic leather, rubber or other material. In some embodiments, the one or more magnets are distributed across the surface so as to allow metallic items to be secured to substantially all points of the surface at the step 408.

The magnetic work clothes described herein comprise a body having a surface and one or more magnets coupled to the surface for holding work items. By incorporating these magnets with the body of the work clothes the present device allows a worker wearing the clothing item to securely hold metallic tools and other items in readily accessible locations along the body via the magnetic attraction of the magnets. Thus, the worker is able to work more efficiently as they are less likely to fumble or drop tools and other items thereby increasing work production. Further, the present device allows for more flexibility in the worker's body position while working because the magnets prevent tools from falling when tilted, even if tilted completely upside down. Accordingly, the magnetic work clothes described herein have numerous advantages.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications can be made in the embodiment chosen for illustration without departing from the spirit and scope of the invention. Specifically, it will be apparent to one of ordinary skill in the art that the body of the clothing item of the present invention can be any type of clothing including, but not limited to aprons, vests, suspenders, pants, shirts, shorts and any other type of clothing. Further, it is apparent to one of ordinary skill in the art that the precise structure of the body of these clothing items can be substantially varied while still being compatible with the present invention. Accordingly, the device of the present invention can be implemented in several different ways and have several different appearances.

What is claimed is:

1. A pair of suspenders comprising:

a. a body including a pair of front straps and a back strap coupled together directly at a node, wherein the front straps and the back strap each have a surface comprising a plurality of layers and an elongated length with a constant width that extends the entire said elongated length; the front straps having a proximal terminal end and a distal terminal end wherein the elongated length extends between said proximal terminal end and said distal terminal end; the back strap having a proximal front end and a distal back end wherein the elongated length extends between said proximal front end and said distal back end; wherein the distal terminal ends of the front straps and the distal back end of the back strap are coupled directly to the node; and b. one or more magnets coupled directly to the surface of each of the front straps above said proximal terminal end of the front straps between said proximal terminal end and said distal terminal end of the front straps for holding work items, wherein the one or more magnets have a magnetic face having a width that is wider than the constant width of the surface of the front straps.

2. The pair of suspenders as claimed in claim 1, wherein a shape of the one or more magnets is selected from a set comprising a strip, a ball bearing, and a disc.

3. The pair of suspenders as claimed in claim 1, wherein the one or more magnets comprises a plurality of magnets that are positioned such that magnetic attraction between each other is insufficient to cause the plurality of magnets to couple to each other.

4. The pair of suspenders as claimed in claim 1, wherein at least one of the one or more magnets comprise a ceramic magnet.

5. The pair of suspenders as claimed in claim 1, wherein at least one of the one or more magnets comprise a neodymium magnet.

6. The pair of suspenders as claimed in claim 1, wherein the surface of the front straps comprises one or more of leather, cotton, cotton/polyester blends, plastic, nylon, vinyl, neoprene, synthetic leather, rubber or other material.

7. The pair of suspenders as claimed in claim 1, wherein the one or more magnets are distributed across the surface of the front straps so as to allow metallic items to be secured to substantially all points of the surface.

* * * * *